US006148923A

United States Patent [19]

Casey

[11] Patent Number: 6,148,923

[45] Date of Patent: Nov. 21, 2000

[54] AUTO-CYCLING PLUNGER AND METHOD FOR AUTO-CYCLING PLUNGER LIFT

[76] Inventor: Dan Casey, 211 Stubblefield Lake, Huntsville, Tex. 77340

[21] Appl. No.: 09/219,054

[22] Filed: Dec. 23, 1998

[51] Int. Cl.[7] ..... E21B 43/00

[52] U.S. Cl. ..... 166/372; 166/68; 166/53; 166/329; 417/56; 417/552; 417/555.2

[58] Field of Search ..... 166/53, 372, 68, 166/105, 70, 153, 156, 329, 105.5; 417/555.2, 555.1, 554, 56, 60, 552

[56] References Cited

U.S. PATENT DOCUMENTS

| | | | |
|---|---|---|---|
| 3,608,633 | 9/1971 | Talley | 166/53 |
| 3,608,634 | 3/1970 | Cochran | 166/124 |
| 4,211,279 | 7/1980 | Isaacks | 166/64 |
| 4,239,458 | 12/1980 | Yeatts | 417/60 |
| 4,275,790 | 6/1981 | Abercrombie | 166/314 |
| 4,502,843 | 3/1985 | Martin | 417/56 |
| 4,629,004 | 12/1986 | Griffin | 166/372 |
| 4,889,473 | 12/1989 | Krueger | 417/56 |
| 4,984,969 | 1/1991 | Fineberg | 417/58 |
| 4,984,970 | 1/1991 | Eickmann | 417/271 |
| 4,986,727 | 1/1991 | Blanton | 417/60 X |
| 5,146,991 | 9/1992 | Rogers, Jr. | 166/369 |
| 5,372,488 | 12/1994 | Turner | 417/554 |
| 5,915,478 | 6/1999 | Brown et al. | 166/329 |

*Primary Examiner*—Victor Batson
*Attorney, Agent, or Firm*—Jo Katherine D'Ambrosio

[57] ABSTRACT

An auto-cycling plunger and method for lifting out condensate and fluid that accumulate and retard production in oil and gas wells. The auto-cycling plunger comprises a tube that defines an inner chamber, one or more flapper sealing rings mounted on the tube and a detachable valve member positioned at one end of the tube. During the method, the auto-cycling plunger free falls down the production tubing string with the detachable valve accelerating faster than the tube. The detachable valve hits the bottom-hole spring first, the tube follows and engages with the detachable valve thereby creating a seal. The liquid collects above auto-cycling plunger and the plunger moves up the production tubing as gas within the well accumulates below it and creates an upward pressure. The auto-cycling plunger repeats it's movement up and down the well without having to shut-in the well thereby continuously removing liquids without stopping production.

27 Claims, 5 Drawing Sheets

AUTO-CYCLING PLUNGER AND METHOD FOR AUTO-CYCLING PLUNGER LIFT

FIELD OF THE INVENTION

The present invention relates to an auto-cycling plunger and method for auto-cycling plunger lift of liquids during the production phase of gas, oil or other types of wells, more particularly low volume wells.

BACKGROUND OF THE INVENTION

Plunger Lift is the removal of fluid from the well formation using the formation gas as the motive source. All natural gas wells produce liquids with the gas flow. A problem arises when fluids accumulate in the well bore of a gas well. This fluid can be fresh water, salt water, condensate and/or oil that migrates toward the well bore with the gas movement. Oil and condensate have market value. In formations that produce unprofitable water, removal is desirable because the presence of water retards and stops the migration of gas to the well bore.

Newer, fast flowing wells atomize and blow this liquid to the surface. Older wells have (or develop) a lower gas to liquid ratio (GLR) that will not push all of the liquid up and out. In these wells, the fluid falls back down the tubing string, restricting the free flow of gas from the formation. A tall column of liquid in the tubing can completely and effectively stop the flowing gas well. Many wells had to be abandoned leaving significant amounts of oil and gas within the well because the flow rate had decreased or stopped completely.

The plunger was first employed for fluid removal about fifty years ago. The first plungers were solid rods with concentric grooves spaced along their outer surfaces. These grooves cause turbulence as gas blows past the plunger. Gas escapes past the plunger due to the absence of a sealing means. Turbulence produces drag which is an aid in lifting the plunger. This style is called a spiral plunger. There is of necessity an annulus between the spiral plunger and the inner wall of the tubing string. Gas can leak upwardly through this annulus.

More recently, U.S. Pat. No. 4,986,727 to Blanton discloses a pressure-operated oil and gas well swabbing device. The '727 reference claims a pressure activated valve comprising a pressure collapsible bladder means, a valve and seat interposed within the fluid passage and means connecting the valve and seat to the pressure collapsible bladder so that the valve and seat are closed when the bladder is collapsed to a degree corresponding to predetermined valve closing pressure. Fineberg in U.S. Pat. No. 4,984,969 teaches a plunger lift tool having a nose assembly to slow the descent of the tool into the well, a valve assembly, and a piston cylinder assembly. When the '969 tool is dropped, the gas and liquids in the well flow through restrictions in the nose assembly, thereby breaking the fall.

A pad plunger as disclosed in U.S. Pat. No. 4,531,891 improves the sealing efficiency relative to the efficiency of the above-described spiral plunger. The pad plunger comprises a central mandrel encircled by articulating segmented pads. The pad shapes vary from manufacturer to manufacturer. Four pads are the optimum number for segmented sealing. Between the mandrel and each pad is a suitable spring that pushes the pad outwardly for sealing contact with the well tubing wall. However, gas pressure still escapes between the pads and through the gaps in the various segments.

U.S. Pat. No. 4,984,970 to Flickman teaches an arrangement of coned disc for a valve pumping chamber. These arrangements are used in high pressure pumps. In the coned ring, a radial distance between the ends of the seal portions is provided to secure that the ring portion remains pressed against an adjacent portion when equal pressures appear on both axial ends of the coned portion. The coned ring is used in a pump to separate two different fluids from each other.

A valveless plunger system for well pumping is disclosed in Martin, U.S. Pat. No. 4,502,843. The groove and flange structure is used for gas pressure lift. The valveless plunger begins descent when the motor valve is closed. The plunger falls slowly under the influence of gravity. A timer opens the motor valve to enable gas to escape through a flow line. This creates a pressure differential across the plunger and drives the plunger upward.

The extant plungers do work in removing liquids from wells that can produce at least 300 cubic feet of gas for every barrel of fluid to be lifted 1000 feet. The problem of routinely removing fluid from oil and gas wells that have a G/L ratio below 300 cubic foot per barrel of fluid lifted 1000 feet remains.

One aspect of the problem to be solved is inefficiencies in the sealing means that is used to isolate the formation fluid from the formation gas as the plunger travels up the tubing/casing string. The typical plunger, moving upward, has fluid above it and gas below it. The plunger is a traveling interface between the gas and the fluid in the well tubing. Poor sealing causes the escape of gas past the plunger and consequently, a loss of gas pressure required for upward travel. Too tight a seal prevent rapid mobility and problems with the plunger becoming stuck within the well tubing. Another aspect of the problem is prior art plungers require that a well be shut in during the use of the plunger lift tool.

None of the references teach or suggest an auto-cycling plunger nor a method for auto-cycling plunger lift.

Consequently, there remains the need for an inexpensive and effective tool and simple method for rapidly and repeatedly removing liquids from low GLR wells. The problem of removing liquids without shutting in the well must also be addressed.

SUMMARY OF THE INVENTION

The auto-cycling plunger and method for auto-cycling plunger lift of the present invention allows low gas to liquid ratio wells to be productive by effectively removing fluids that retards production. Alternatively the plunger is useful in an oil well to promote the movement of oil in low pressure wells up through the casing. The improved seal between the production tubing and the plunger allows a minimum of gas pressure to remove the liquid. The auto-cycling plunger used according to the method of this invention permits the removal of liquid from the formation without shutting in the well. Another feature of the auto-cycling plunger is the ability to remove paraffin buildup from the tubing wall as it is performing and without shutting-in the well.

A preferred auto-cycling plunger for lift of condensate and fluid out of an oil or gas well comprises a tube having an upper section, a middle section, and a lower section, the lower section forming a retrieval end, the upper section, middle section and lower section defining a continuous chamber. Preferably, one or more flapper sealing rings are mounted along the tube, the sealing rings extending outwardly from the tube; and a detachable valve member is positioned at the retrieval end. In one embodiment, the upper section comprises an internal wall and an external wall, the internal wall defining one or more grooves. the middle section of the tube comprises a central mandrel separate from the upper section and the lower section, the central mandrel comprising an upper end and a lower end for detachable engagement with the upper section and lower section of the plunger. A preferred auto-cycling plunger further comprises at least two or more spacers encircling the central mandrel. one or more flapper sealing rings are interposed between the spacers.

Preferably, the upper end and the lower end of the central mandrel are threaded for detachable engagement with the upper section and lower section of the plunger so that the flapper sealing rings are held in place between the spacers when the upper section is threaded onto the upper end of the central mandrel and the lower section is threaded onto the lower end of the central mandrel.

In one aspect, the middle section has an external wall and an internal wall and the flapper sealing rings are mounted on the external wall so that the flapper sealing rings extend outwardly from the plunger. Preferably, the flapper sealing rings are flimsy, elastomeric sealing rings and the flapper sealing rings are sized to cause a positive seal when placed within production string tubing of the gas well.

Preferably, the outer diameter of the flapper sealing ring has an interference fit with production string tubing of the gas well; In one aspect, the outer diameter of the flapper sealing ring is between about 2% to about 8% larger than the inner diameter of production string tubing of the gas well. In another aspect, the flapper seal comprises a width to thickness ratio within a range of from about 0.10 to about 0.20.

Preferably, the retrieval end of the lower section is angular-shaped to align and receive the detachable valve member. In one preferred embodiment, the retrieval end of the lower section comprises a scraper edge for paraffin removal from inner walls of production string tubing.

The detachable valve member can comprise a sphere sized to be received within the retrieval end of the plunger. In this embodiment, the inner diameter of the retrieval end is within a range of from about ¼ mm to about 3 mm larger than the diameter of the sphere. Alternatively, the detachable valve member can comprise a bullet-shaped shuttle having a spherical end, the spherical end is preferably sized to be received within the retrieval end of the plunger. In this embodiment, the inner diameter of the retrieval end is within a range of from about ¼ mm to about 3 mm larger than the diameter of the spherical end of the bullet-shaped shuttle.

In another aspect of this invention, the retrieval end of the lower section comprises an inner wall and an outer wall, the inner wall defines at least one groove for receiving an O-ring and the O-ring is sized so that it fits snugly about the detachable valve member when the detachable valve member is engaged within the retrieval end of the plunger. Preferably, the inner wall of the retrieval end forms a seat for sealing the lower section when the detachable valve is engaged within the retrieval end. The inner wall of the retrieval end can form a sealing groove and an O-ring is fitted within the sealing groove for sealing the lower section when the detachable valve is engaged within the retrieval end. In one embodiment, the retrieval end further comprises a choke.

In an alternative embodiment, the upper section, middle section and lower section form an integral tube having an inner wall and an outer wall, and the flapper seals are mounted on the outer wall of the tube so that they extend outward from the tube. In still another alternative embodiment, the middle section and the upper section can form an integral tube that is threadably connected to the lower section.

A preferred method for auto-cycling plunger lift takes place in a gas or oil well having a lubricator positioned at the top of the production string tubing and a bottom-hole bumper spring positioned at the bottom of the production string. The lubricator preferably comprises an arrival spring and a catcher. The preferred method of this invention comprises the following steps: stopping production flow; placing auto-cycling plunger with a detachable valve member in the lubricator so that they are held by the catcher, the auto-cycling plunger comprising a retrieval end and flapper sealing rings; starting production flow so that gas well is pressurized; releasing the catcher thereby allowing the detachable valve member and auto-cycling plunger to fall independently through the production string tubing until liquid in the bottom of the well collects at top of plunger; striking bottom-hole bumper spring with detachable valve member; striking bottom-hole bumper spring with plunger so that the retrieval end of the plunger captures the detachable valve member causing a valve seal within the plunger as formation gas pressure pushes against the detachable valve member;

Preferably, a seal is effected between flapper sealing rings and the walls of the production string tubing; allowing formation gas pressure to push plunger with captured detachable valve member upward thereby pushing liquid above plunger towards top of production string tubing; drawing off liquid and piping out gas as plunger reenters lubricator thereby reducing pressure below plunger allowing detachable valve member and plunger to fall back down production string tubing repeating steps e) through j) without shutting in well.

In the preferred method, the retrieval end of the lower section comprises an inner wall and an outer wall, the inner wall defining at least one groove for receiving an 0-ring, the 0-ring sized so that it fits snugly about the detachable valve member when the detachable valve member is engaged within the retrieval end of the plunger. The inner wall of the retrieval end can form a sealing groove and an 0-ring is fitted within the sealing groove for sealing the lower section when the detachable valve is engaged within the retrieval end.

DETAILED DESCRIPTION OF THE INVENTION

The auto-cycling plunger 10 of this invention lifts out condensate and fluid that accumulate and retard production in oil and gas wells. The improved sealing of the auto-cycling plunger allows a minimum amount of gas to lift the plunger and the column of liquid (oil, water, condensate etc.) above the plunger up the production tubing and out of the well. During the method of this invention, the auto-cycling plunger free falls down the production tubing string until it hits the bottom-hole spring and collects the liquid above it. It then moves up the production tubing as gas within the well accumulates below it and creates an upward pressure. Because of its unique tube and detachable valve arrangement, the auto-cycling plunger repeats it's movement up and down the well without requiring shut-in of well thereby continuously removing liquids without stopping production.

Figure 1:
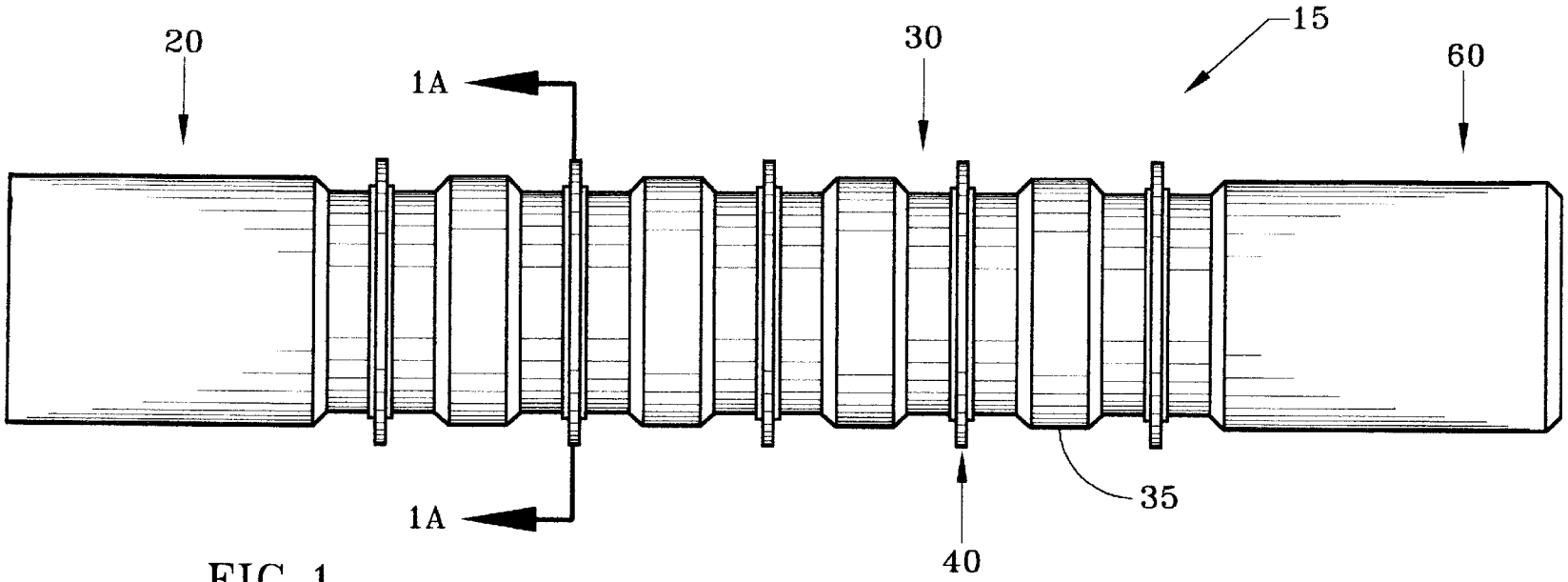
FIG. 1 illustrates one embodiment of the auto-cycling plunger.
Figure 1A:
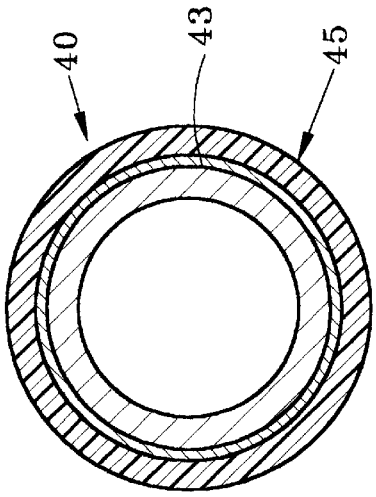
Figure 2:
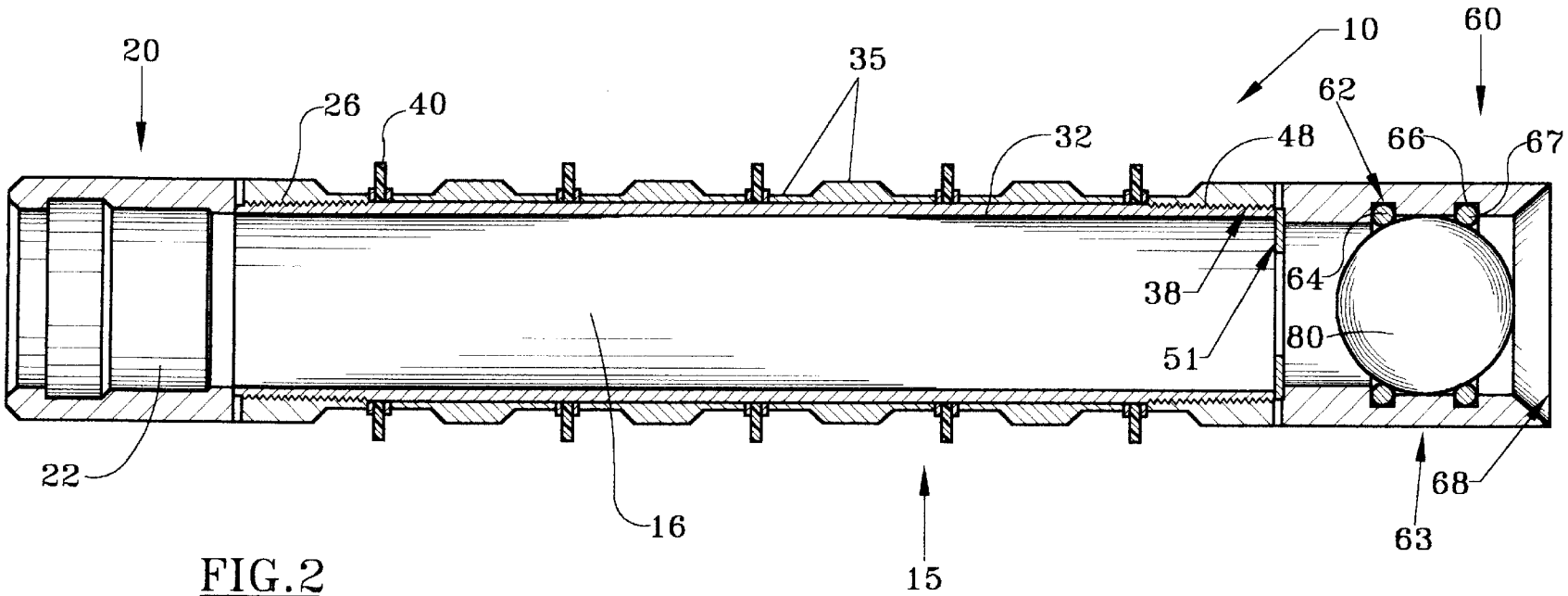
FIG. 2 is a cross-sectional view of FIG. 1

The apparatus and method of this invention can be adapted to either an oil or a gas well. In the detailed description of this invention, the discussion is limited to a gas well, but the invention is applicable to oil or gas production wells. Referring to FIGS. 1 and 2, the preferred autocycling plunger comprises a tube 15, a detachable valve 80 that can sit within a lower section 60 of the tube 15 and flapper sealing rings 40 that are mounted along the tube 15. The tube 15 defines a continuous chamber 16 that allows gas to freely move through it. The tube 15 comprises an upper section 20, a middle section 30, and the lower section 60. In one embodiment, the upper section 20, middle section 30 and lower section 60 comprise three separate pieces that are threadedly connected to each other. The middle section 30 comprises a central mandrel 32 that is threaded on either end 26, 38 for engaging with the upper and lower sections 20, 60. Flapper sealing rings 40 are mounted onto the central mandrel 32 to create a seal between the plunger and the production tubing 55 or well casing. One or more spacers 35 surround the central mandrel 32 to separate the sealing rings 40 and hold the sealing rings 40 firmly in place when the upper and lower sections 20, 60 are tightly threaded onto the central mandrel 32.

Figure 6:
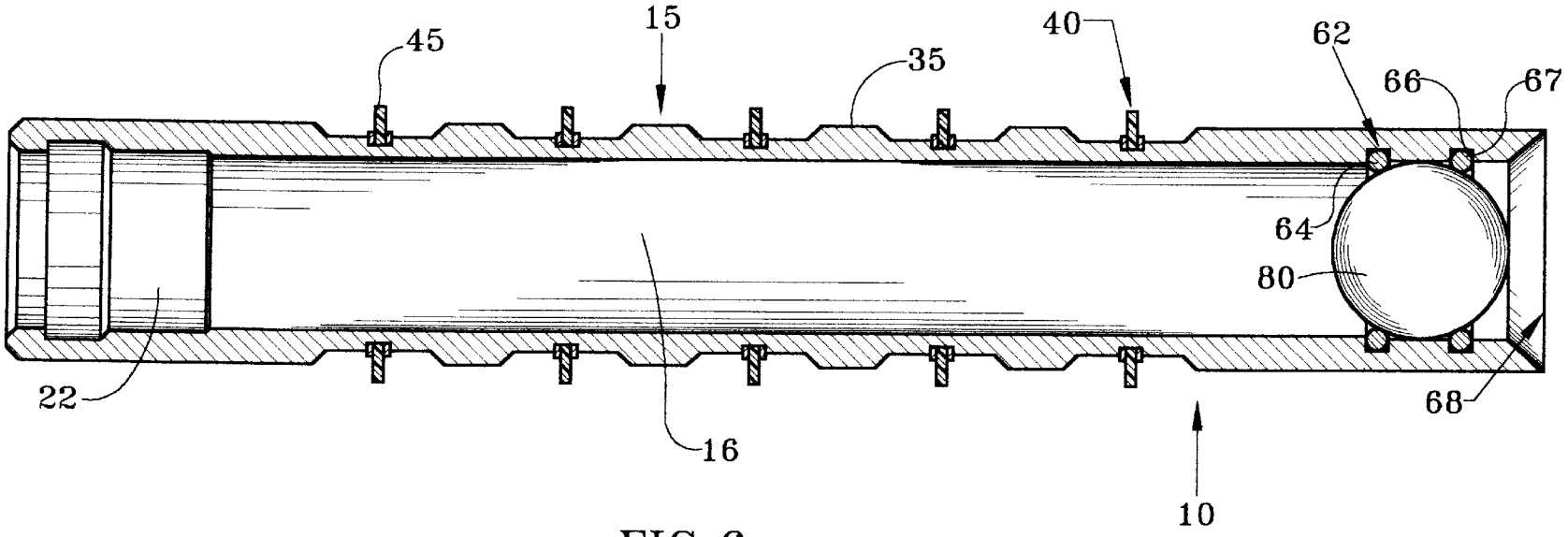
FIG. 6 is a cross-sectional view of a one piece auto-cycling plunger

In one preferred embodiment, the upper section 20 is threaded on one end for connecting to the middle section, 30. Alternatively, as illustrated in FIG. 6, the upper section and middle section 30 are integral and form one continuous tube. Alternatively, the upper section 20 middle section 30 and lower section 60 can comprise one integral unit with a continuous chamber 16. Preferably, the upper section of the plunger 10 in any of the described embodiments can comprise one or more internal grooves 22 opposite the threaded end, the internal grooves 22 are adapted for engaging with a retrieval tool for retrieval of the plunger from the well, if necessary. The configuration of internal grooves 22 is known in the art as an internal fishneck.

As illustrated in FIGS. 1 and 2, the middle section 30 preferably comprises a hollow central mandrel 32, flapper sealing rings 40 and removable spacers 35 for securing the sealing rings 40. The central mandrel 32 defines a hollow central chamber 16 that is unobstructed so that the auto-cycling plunger 10 can free fall down the production tubing during the downward cycle with the least amount of friction within the chamber. Preferably, the ratio of the diameter of the central chamber 16 to the production tubing is approximately 0.625 or greater to achieve the free fall effect.

Figure 4:
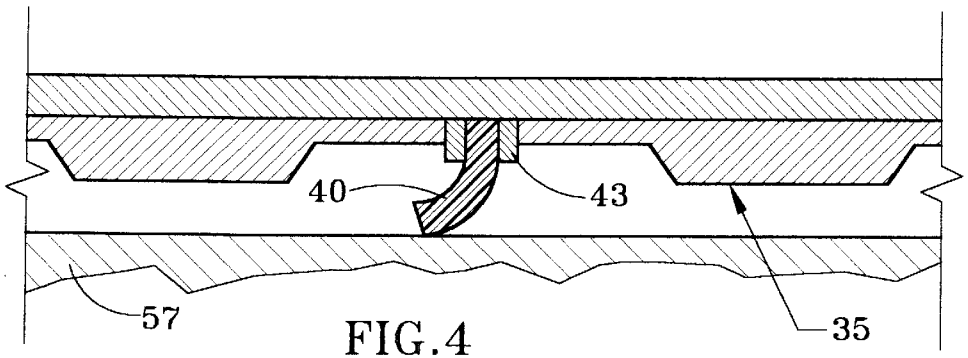
FIG. 4 is an exploded view of the disc seals during upward travel.

The flapper sealing rings comprise an inner ring 43 and an outer, flimsy sealing membrane 45. Preferably the inner ring 43 is comprised of rigid material such as metal, hard elastomeric or plastic to give form and shape to the sealing ring 40. The outer sealing membrane 45 is flexible in that its shape can be somewhat distorted then returned to its natural shape without damage to the membrane 45. The ability to return to shape is common to elastomeric products. The flexible sealing membrane 45 is fixably attached in a vulcanizing process to the metallic inner ring 43. The outer edge of the sealing membrane makes sealing contact with the production tubing wall 55 as seen in FIG. 4. When used with the method of this invention, the sealing rings 40 form a barrier membrane separating the gas volume below the plunger 10 from the fluid load above the plunger 10.

It is understood that the flexible sealing membrane 45 can also be affixed to a one-piece molded unit as shown in FIG. 6.

One preferred embodiment of the sealing membrane 45 is flimsy in that it has the ability to readily abandon its natural shape and to bend in the presence of a limited applied force. The membrane 45 offers very little resistance to a shape change. The sealing membrane 45 is preferably sufficiently thin for flexibility and to counteract the effects of gas entrainment. The preferred flapper sealing membrane 45 has a width to thickness ratio within a range of from about 0.10 to about 0.20. Another important feature of the flimsy sealing ring is that it does not cause excessive friction at the tubing interface during its free fall down the tubing. Friction at the interface is greater on the up-travel because it is pressure-induced. However, the pressure, typically at 3 PSI, over a contact area of less than 0.2 sq. inches, does not create excessive friction. Preferably the sealing membrane 45 is comprised of an elastomeric material, either rubber, or more preferred, urethane type material.

Figure 3:
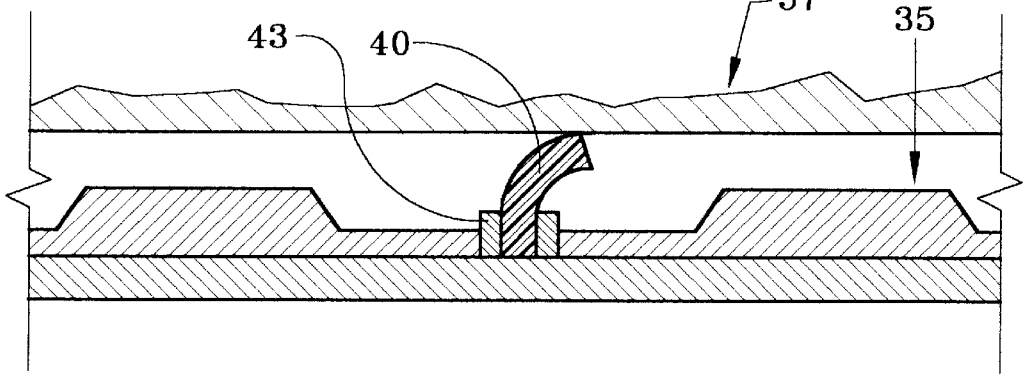
FIG. 3 is an exploded view of the flexible sealing ring during downward travel.

Referring to FIGS. 3 and 4, the seal is preferably oversized in relation to the production tubing to insure a positive seal. FIG. 3 illustrates the shape of the sealing membrane 45 during the downward fall as it curls against the wall of the production tubing 55. The oversizing causes the seal to partially curl. The curl is a major attribute of this feature of the invention. The pressure on the inside of the curl of the sealing membrane 45 pushes equally against all of the membrane 45 including the very edge portion which is in contact with the production tubing wall 55. This contact and the pressure behind it makes the seal possible. FIG. 4 illustrates the shape of the sealing member 45 during the upward travel of the auto-cycling plunger 10 as the gas pressure under the sealing member 45 causes a domed shape.

The outer diameter of the sealing membrane 45 is from about 3% to about 6%, preferably 5%, larger than the inner diameter of the production string tubing. This dimension produces an interference fit between the sealing member 45 and the inner tubing wall 55. The interference fit causes the membrane to roll-form into a constricted shape and diameter that exerts a sealing contact with the inner production tubing wall 55.

The preferred shape of the sealing membrane 45 is planer in construction with a width to thickness ratio that allows the membrane to form, when in use, an optimized shape. The shape assumed by the elastomeric sealing membrane 45 balances the pressure differential across the plunger with the drag created by the seal contact area. The shape assumed by the sealing membrane 45 balances the differential by allowing and encouraging the plunger 10 to move in that direction that reduces the differential. The drag created by the sealing membrane 45 as it rubs the production tubing wall 55 is a function of the coefficient of friction of the elastomer against steel. The sealing membrane 45 is preferably larger than the tubing 55 to encourage definite contact with the tubing wall. The size and interference fit of the seal produces a shape of seal 45 that encourages lift over drag.

The number of flexible sealing rings used is a variable dependent on the well application. Some wells have multiple weight tubing, i.e. varying dimensions. The number of and the thickness ratio for the seals will vary accordingly and can be easily determine by those in the art. The width to thickness ratio of the membrane 45 is sufficient to hold the differential pressure and thin enough to permit the sealing membrane 45 to change shape and roll into a new shape during reciprocation of travel. In a preferred embodiment, one or more spacers 35 are slideably positioned over the central mandrel 32 to separate the flexible sealing rings 40. The outside diameter of the upper section 20, lower section 60 and the spacers 35 is approximately 2% to 8% smaller than the inner diameter of the production tubing. Preferably, the outside diameter of the upper section 20, lower section 60 and the spacers 35 is approximately 5% smaller than the inner diameter of the production tubing. This diameter sizing provides clearance for free movement of the auto-cycling plunger 10 inside the tubing. This novel plunger is capable of operating in a tubing string 55 or a casing string, i.e. a well without production tubing.

Preferably, the lower section 60 defines a hollow chamber continuous with the hollow chamber of the upper section 20 and middle section 30. The lower section 60 is threaded onto the central mandrel 32 thereby holding the spacers 35 and sealing rings 40 in place. In one preferred embodiment, the lower section 60 forms a retrieval end 63. The retrieval end 63 is designed for retrieval of the detachable valve 80 at the bottom of the production string 55. The internal walls of the retrieval end 63 are grooved for O-rings 64, 67. One groove 62 and O-Ring 64 are for sealing the continuous chamber 16 when the tube 15 is engaged with the detachable valve 80. The second groove 66 and second O-Ring 67 are shaped to receive and engage the detachable valve 80 of the plunger 10 within the retrieval end 63 of the tubing 15. The retrieval end is preferably angular-shaped to align and receive the detachable valve 80. In one aspect, the retrieval end 63 has an inner diameter, not including O-rings 64, 67 within a range of from about ¼ mm to about 3 mm larger than the detachable valve 80.

Preferably, the very most lower edge 68 of the lower section 60 is sharply angled to form a scraper. Paraffin often collects along the inner wall of the production tubing 55 and the knife edged scraper 68 can function to remove paraffin during the free fall of the auto-cycling plunger 10 down the production tubing.

Figure 5:
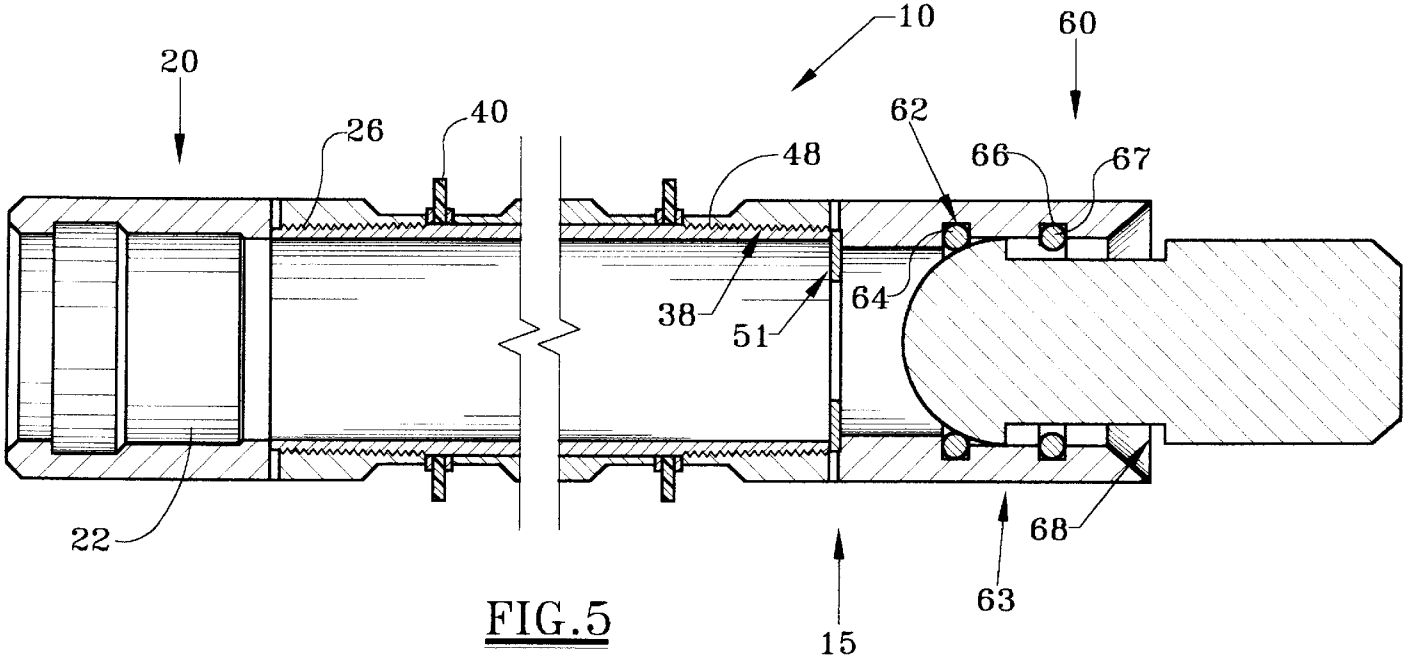
FIG. 5 is a view of the bullet shuttle.

FIGS. 2 and 5 illustrate the detachable valve 80 of this invention when engaged with the tube 15. As the auto-cycling plunger 10 begins its free fall down the production string tubing 55, the detachable valve 80 separates from the tube 15 because of reduced gas pressure. This will be discussed in more detail during the description of the method of this invention. In a preferred embodiment, the detachable valve 80 is a sphere sized to be received within the retrieval end 63 as illustrated in FIG. 2. This sphere-shaped valve can be referred to as a ball shuttle valve 80. Alternatively, the detachable valve 82 can be elongated with a rounded end as illustrated in FIG. 5, this embodiment is referred to as a bullet shuttle valve 82. The rounded shape of either embodiment of the detachable valve 80, 82 facilitates central alignment within the retrieval end 63 when the valve 80, 82 engages with the tubing 15. One preferred detachable valve 80 is made from metallic or elastomeric material or a combination thereof. The bullet shuttle valve 82 can also be made from metallic or elastomeric material or a combination thereof. Either embodiment 80, 82 can vary in density to accommodate well conditions.

The detachable valve 80, 82 has a smaller surface area to weight ratio than the main body or tube 15 of the plunger 10. In one preferred embodiment, the detachable valve 80, 82 has a ratio of 16.5, whereas the main body has a surface area to weight ratio of 28. This ratio means the main body produces more drag relative to the traveling valve 80, 82. This extra drag, plus the minimal drag at the seal interface, causes the main body to fall at a slower rate than the detachable valve 80,82. The detachable valve 80, 82 can also be referred to as a traveling valve because it detaches from the tubing 15 and free falls down the production string 55 apart from the tubing 15.

Referring to FIG. 2, the lower section further comprises a choke 51 positioned in the chamber 16 above the first groove 62. The choke 51 can be a washer that is fixed into the chamber 16 as a limited restriction. The purpose is to slow down the fall rate of the tube 15. To slow down the fall rate of the traveling valve, a lighter density design is used such as the bullet shuttle. The use and design of chokes are well know in the art.

Figure 7:
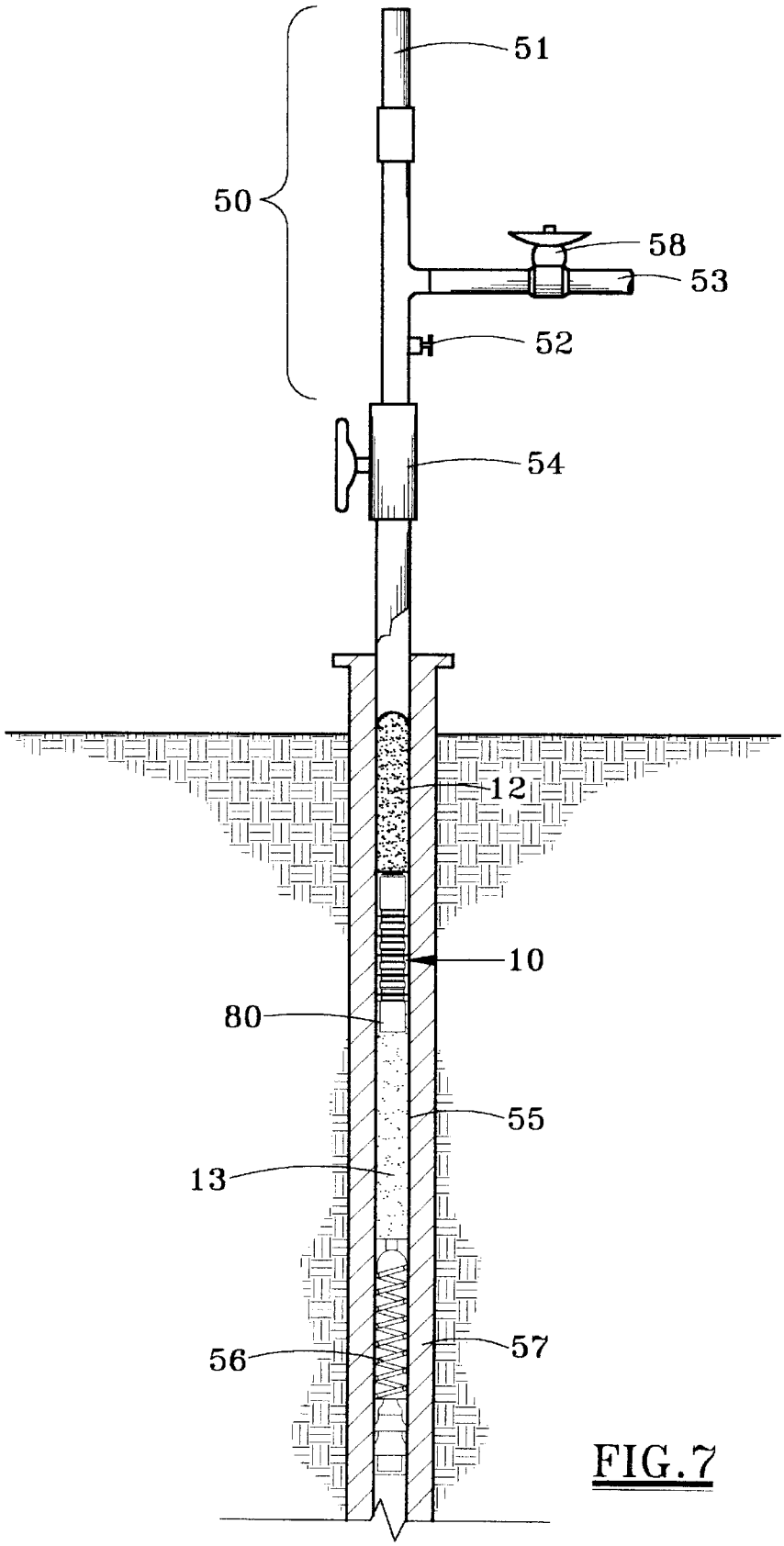
FIG. 7 is a schematic of one method of auto-cycling plunger lift illustrating the well and lubricator system.

FIG. 7 is a schematic illustrating the method of auto-cycling plunger lift. The method for auto-cycling plunger lift is practiced in a gas well having a lubricator 50 positioned at the top of the production string tubing 55 and a bottom-hole bumper spring 56 positioned at the bottom of the production string 55, the lubricator 50 comprises an arrival spring 51, which cushions the arrival of the plunger 10 within the lubricator 50, and a catcher 52. The lubricator 50 is a special piping arrangement installed for plunger lift. It is positioned on top of the well to capture the auto-cycling plunger 10. The lubricator 50 also has an outlet pipe 53 for piping out the production gas. The flow of gas production is stopped when the master valve 54 is closed. The top of the lubricator 50 is then opened and the auto-cycling plunger 10 with its detachable valve member 80 is placed within and held in place by the catcher 52. The production flow is restarted so that the gas well is pressurized and the catcher released thereby allowing the plunger 10 to begin free fall down the production string tubing 55. Because the gas pressure is not sufficient to hold the detachable valve 80 within the retrieval end 63 of the auto-cycling plunger 10, the detachable valve 80 separates from the auto-cycling plunger 10 and falls independently through the production string tubing 55. The tube 15 of the auto-cycling plunger 10 is a hollow cylinder and allows the gas and liquid in the production string 55 to pass through its central chamber 16 until liquid in the bottom of the well collects at the top of plunger 10. The detachable valve 80 strikes the bottom-hole bumper spring 56 first and the tube 15 follows. The tube 15 strikes the bottom-hole bumper spring 56. Upon striking the bottom-hole bumper spring 56, the retrieval end 63 of the plunger 10 engages with the detachable valve member 80 so that the valve 80 effects a snug valve seal within the auto-cycling plunger 10 as formation gas pressure pushes against the detachable valve member 80. Preferably, the internal walls of the retrieval end 63 are grooved for O-rings 64, 67 as depicted in FIG. 2. One groove 62 and O-Ring 64 are for sealing the continuous chamber 16 when the tube 15 is engaged with the detachable valve 80. The second groove 66 and second O-Ring 67 are shaped to receive and engage the detachable valve 80 of the plunger 10 within the retrieval end 63 of the tubing 15.

In a preferred method of this invention, a seal is also effected between the flapper sealing rings 40 and the walls of the production string tubing 55. Because the flow outlet at the surface remains open during this method, the formation gas inflows the bottom of the production string tubing 55. Formation gas pressure pushes the auto-cycling plunger 10 with its captured detachable valve member 80 upward thereby pushing liquid above plunger 10 towards the top of production string tubing.

Preferably, the liquid is drawn off and the gas piped out as the plunger 10 reenters the lubricator 50 thereby reducing pressure below plunger 10. When the pressure is reduced below the plunger 10, the detachable valve member 80 falls away from the plunger 10 breaking the seal and thereby allowing the plunger to fall back down the production string tubing 55. These steps of the method of auto-cycling plunger lift are repeated automatically and without shutting in well or leasing production.

EXAMPLE

A test stand of 2" I.D. clear tubing was used to view the pad plunger and the global change to auto-cycling plunger in action. The lower portion of the tubing was filled with water. The pad plunger was dropped into the tubing from a height of 20'. The pad plunger fell through the (atmospheric) upper portion of the tubing at a rate of 10'/second. The fall rate through the water was 1'/second. Shop air was applied to the bottom of the test-stand tubing to simulate a flowing well. The pad plunger rose with the water and bubbles until the density of the water would no longer support the weight of the plunger and it fell back to the bottom. The pad plunger stayed on bottom even though the water and air boiled around and past it.

The shop air supply was rated at 13 MCFD at 40 PSI continuous. The instantaneous rate through the supply line is 39 MCFD @ 110 PSI. A higher flow rate from the compressor would have uplifted the pad plunger to the surface. This test created a baseline for measurements of efficiency of the auto-cycling plunger of this invention. The test stand included a means for returning water to the bottom of the tubing. A sufficiency of water in the system insured a ready supply at the bottom of the tubing to match the conditions of a gas well. Likewise, the air from the compressor was vented at the surface.

For the second phase of testing, the shuttle bullet and plunger were dropped into the clear tubing. The fall rate through the fluid was 3.70 feet/second for the plunger. When shop air was applied to the bottom of the tubing, the plunger and shuttle rose as a unit to the top of the tubing. As the plunger rose swiftly to the top, it pushed 100% of the water above it to the surface. The tubing below the rising plunger was wiped clear of liquids just as a windshield wiper cleans an automotive windshield. At the top of the tubing, a tee had been installed to divert the fluids in a circuitous manner to the bottom of the clear tubing. When the auto-cycling plunger passed above the tee, the shuttle portion of the plunger lost its holding force with the tube due to the loss of the differential pressure across the plunger. The shuttle fell, followed momentarily by the auto cycling plunger.

The water reservoir had let more water into the bottom of the tubing. The shuttle and plunger each fell through this water before rejoining at the bottom of the tubing. The air input was still active. The moment the shuttle and plunger rejoined, closing the by-pass, the plunger moved again to the surface. This cycle of rise and fall and water movement to the surface was repeatable and continuous. If the air input was closed during the rising phase of the cycle, the plunger and shuttle would stall in the tubing. To stall in the tubing without falling backwards is a desirable feature.

The foregoing description is illustrative and explanatory of preferred embodiments of the invention, and variations in the size, shape, materials and other details will become apparent to those skilled in the art. It is intended that all such variations and modifications which fall within the scope or spirit of the appended claims be embraced thereby.

What is claimed is:

1. An auto-cycling plunger for lift of condensate and fluid out of a gas or oil well, the plunger comprising:

a tube having an upper section, a middle section, and a lower section, the lower section forming a retrieval end, the upper section, middle section and lower section defining a continuous chamber;

one or more flapper sealing rings mounted along the tube, the sealing rings extending outwardly from the tube; and a detachable valve member positioned at the retrieval end.

2. The auto-cycling plunger of claim 1 wherein the upper section comprises an internal wall and an external wall, the internal wall defining one or more grooves.

3. The auto-cycling plunger of claim 1 wherein the middle section of the tube comprises a central mandrel separate from the upper section and the lower section, the central mandrel comprising an upper end and a lower end for detachable engagement with the upper section and lower section of the plunger.

4. The auto-cycling plunger of claim 3 further comprising at least two spacers encircling the central mandrel.

5. The auto-cycling plunger of claim 4 wherein the one or more flapper sealing rings are interposed between the spacers.

6. The auto-cycling plunger of claim 4 wherein the upper end and the lower end of the central mandrel are threaded for detachable engagement with the upper section and lower section of the plunger so that the flapper sealing rings are held in place between the spacers when the upper section is threaded onto the upper end of the central mandrel and the lower section is threaded onto the lower end of the central mandrel.

7. The auto-cycling plunger of claim 1 wherein the middle section has an external wall and an internal wall and the flapper sealing rings are mounted on the external wall so that the flapper sealing rings extend outwardly from the plunger.

8. The auto-cycling plunger of claim 1 wherein the flapper sealing rings are flimsy, elastomeric sealing rings.

9. The auto-cycling plunger of claim 8 wherein the flapper sealing rings are sized to cause a positive seal when placed within a production string tubing of the gas well.

10. The auto-cycling plunger of claim 8 wherein the outer diameter of the flapper sealing ring has an interference fit with production string tubing of the gas well.

11. The auto-cycling plunger of claim 8 wherein the outer diameter of the flapper sealing ring is between about 2% to about 8% larger than the inner diameter of production string tubing of the gas well.

12. The auto-cycling plunger of claim 1 wherein each of the flapper sealing rings comprises a width to thickness ratio within a range of from about 0.1 to about 0.2.

13. The auto-cycling plunger of claim 1 wherein the retrieval end of the lower section is angular-shaped to align and receive the detachable valve member.

14. The auto-cycling plunger of claim 1 wherein the retrieval end of the lower section comprises a scraper edge for paraffin removal from inner walls of production string tubing.

15. The auto-cycling plunger of claim 1 wherein the detachable valve member comprises a sphere sized to be received within the retrieval end of the plunger.

16. The auto-cycling plunger of claim 15 wherein an inner diameter of the retrieval end is within a range of from about ¼ mm to about 3 mm larger than the diameter of the sphere.

17. The auto-cycling plunger of claim 1 wherein the detachable valve member comprises a bullet-shaped shuttle having a spherical end, the spherical end sized to be received within the retrieval end of the plunger.

18. The auto-cycling plunger of claim 17 wherein an inner diameter of the retrieval end is within a range of from about ¼ mm to about 3 mm larger than the diameter of the spherical end of the bullet-shaped shuttle.

19. The auto-cycling plunger of claim 1 wherein the retrieval end of the lower section comprises an inner wall and an outer wall, the inner wall defining at least one groove for receiving an O-ring, the O-ring sized so that it fits snugly about the detachable valve member when the detachable valve member is engaged within the retrieval end of the plunger.

20. The auto-cycling plunger of claim 19 wherein the inner wall of the retrieval end forms a seat for sealing the lower section when the detachable valve is engaged within the retrieval end.

21. The auto-cycling plunger of claim 19 wherein the inner wall of the retrieval end forms a sealing groove and an O-ring is fitted within the sealing groove for sealing the lower section when the detachable valve is engaged within the retrieval end.

22. The auto-cycling plunger of claim 1 wherein the retrieval end further comprises a choke.

23. The auto-cycling plunger of claim 1 wherein the upper section, middle section and lower section form an integral tube having an inner wall and an outer wall, and the flapper seals are mounted on the outer wall of the tube so that they extend outward from the tube.

24. The auto-cycling plunger of claim 1 wherein the upper section and middle section form an integral tube having an inner wall and an outer wall, the tube further comprising the flapper seals mounted on the outer wall of the tube so that the seals extend outward from the tube.

25. A method for auto-cycling plunger lift in a gas or oil well having a lubricator positioned at a top of a production string tubing and a bottom-hole bumper spring positioned at a bottom of the production string, the lubricator comprising an arrival spring and a catcher, the method comprising:

a) stopping production flow;

b) placing auto-cycling plunger with a detachable valve member in the lubricator so that they are held by the catcher, the auto-cycling plunger comprising a retrieval end and flapper sealing rings;

c) starting production flow so that said gas well is pressurized;

d) releasing the catcher thereby allowing the detachable valve member and auto-cycling plunger to fall independently through the production string tubing until liquid in the bottom of the well collects at top of said plunger;

e) striking the bottom-hole bumper spring with the detachable valve member;

f) striking the bottom-hole bumper spring with the plunger so that the retrieval end of the plunger captures the detachable valve member causing a valve seal within the plunger as formation gas pressure pushes against the detachable valve member;

g) effecting a seal between the flapper sealing rings and the walls of the production string tubing;

h) allowing formation gas pressure to push the plunger with the captured detachable valve member upward thereby pushing liquid above the plunger towards top of the production string tubing;

i) drawing off liquid and piping out gas as the plunger reenters lubricator thereby reducing pressure below the plunger;

j) allowing the detachable valve member and the plunger to fall back down the production string tubing;

k) repeating steps e) through j) without shutting in well.

26. The method of claim 25 wherein the retrieval end of a lower section comprises an inner wall and an outer wall, the inner wall defining at least one groove for receiving an O-ring, the O-ring sized so that it fits snugly about the detachable valve member when the detachable valve member is engaged within the retrieval end of the plunger.

27. The method of claim 25 wherein the inner wall of the retrieval end forms a sealing groove and an O-ring is fitted within the sealing groove for sealing a lower section when the detachable valve is engaged within the retrieval end.

* * * * *